US005918655A

United States Patent [19]

Corey

[11] Patent Number: 5,918,655

[45] Date of Patent: Jul. 6, 1999

[54] VIEW-THROUGH CELLULAR WINDOW COVERING

[75] Inventor: John A. Corey, Melrose, N.Y.

[73] Assignee: Comfortex Corporation, Watervliet, N.Y.

[21] Appl. No.: 09/042,954

[22] Filed: Mar. 17, 1998

[51] Int. Cl.[6] ..... A47H 5/00

[52] U.S. Cl. ..... 160/84.05

[58] Field of Search ..... 160/84.05, 84.04, 160/84.02, 89, 84.01, 121.1, 115, 166.1 R, 176.1 R

[56] References Cited

U.S. PATENT DOCUMENTS

| | | | |
|---|---|---|---|
| 2,672,088 | 3/1954 | Orr . | |
| 2,757,727 | 8/1956 | Findell . | |
| 2,884,005 | 4/1959 | Honerekamp et al. . | |
| 3,011,518 | 12/1961 | Day et al. . | |
| 3,329,163 | 7/1967 | Barker et al. . | |
| 4,884,612 | 12/1989 | Schnebly et al. | 160/84.04 |
| 4,984,617 | 1/1991 | Corey | 160/89 X |
| 5,165,459 | 11/1992 | Gaber et al. . | |
| 5,193,601 | 3/1993 | Corey . | |
| 5,339,882 | 8/1994 | Judkins . | |
| 5,445,204 | 8/1995 | VanderWielen . | |
| 5,454,414 | 10/1995 | Colson et al. | 160/84.02 |
| 5,680,891 | 10/1997 | Prince | 160/84.05 |
| 5,733,632 | 3/1998 | Marusak . | |

*Primary Examiner*—David M. Purol
*Attorney, Agent, or Firm*—Rader, Fishman & Grauer PLLC

[57] ABSTRACT

A view-through cellular window covering includes a plurality of cells arranged parallel to one another. Each cell has at least one side, and a joint unites adjacent sides of each cell. The adjacent sides of each cell are pivotable about the joint such that each cell is variably adjustable between a collapsed position and an opened position. A first cord includes a plurality of elements positioned there along, and each of the elements is engaged to or otherwise attached to one of the upper sides of a corresponding one of the plurality of cells. A second cord includes a plurality of members positioned there along, and each of the members is engaged to or otherwise attached to one of the lower sides of a corresponding one of the plurality of cells. By longitudinally moving the cords, the plurality of cells can be adjusted between the collapsed position, where adjacent cells are separated, and the opened positioned, where adjacent cells contact one another. By collapsing and expanding the cells, the window covering of the present invention can achieve adjustable light-control, modulatable view through, light diffusion, excellent insulation value, all in an aesthetically pleasing design.

6 Claims, 4 Drawing Sheets

VIEW-THROUGH CELLULAR WINDOW COVERING

TECHNICAL FIELD

The present invention generally relates to window coverings and treatments. More specifically, the present invention relates to an adjustable view-through cellular shade or window covering.

BACKGROUND INFORMATION

Today there are a significant number of attractive window coverings and treatments available to the consumer. At one time, however, the offerings were limited to traditional window coverings, i.e., curtains, draperies, shades and venetian blinds. While the traditional offerings are still prevalent, many newer designs offer greater functional value and aesthetic quality. Indeed, the functional limitations associated with traditional window coverings have led to the design of new and unique alternative window coverings.

A weakness associated with traditional venetian blinds is their poor insulation value. Also, the unsightly vertically displaced control cords of traditional venetian blinds negatively influence their aesthetic presentation. Yet, an advantage of traditional venetian blinds is their variable view-through and light control capability.

Partly in response to the limitations inherent in the structures associated with traditional conventional window coverings like venetian blinds, fresh window coverings and treatments, such as multi-cellular shades, were developed and welcomed by consumers. In the broad sense, a cellular shade is a pleated window covering having a plurality of cells arranged adjacent to one another. The adjacent cells are bonded at their edges to form a complete sheet for the window covering. These multi-cellular shades provide significant insulating value, uniform light diffusion and a desirable aesthetic presentation, but they typically have no view-through capability. Unlike traditional venetian blinds, which provide easy modulatable view-through and light control by simply adjusting the orientation of the horizontally disposed slats or vanes, traditional multi-cellular shades are not capable of separating the plurality of cells, thus preventing a view-through option. Therefore, in order for a person to see through a window which is outfitted with a traditional multi-cellular shade, it is necessary to collectively raise and gather the plurality of cells, i.e., raise the entire window covering. However, raising the whole cellular window shade is laborious and time consuming.

In light of the advantages of venetian blind and multi-cellular window shades, the ideal wind treatment would provide the characteristics of both, i.e., a window treatment having excellent insulation value, adjustable light-control, modulatable view-through, and light diffusion, all together with an aesthetically pleasing presentation. Thus, a need exists for a window covering which can combine all of the these functional advantages into an easily and readily manufactured window covering. The structure of the present invention solves the above dilemma.

SUMMARY OF THE INVENTION

Briefly, the present invention satisfies this need and overcomes the shortcomings of the prior art through the provision of a view-through cellular window covering, which includes a plurality of cells arranged parallel to one another. Each cell has at least one side, and a joint unites adjacent sides of each cell. The adjacent sides are pivotable about the joint such that each cell is variably adjustable between a collapsed position and an opened position. Included in the invention is a means for variably adjusting the plurality of cells between the collapsed position, where adjacent cells are separated, and the opened positioned, where adjacent cells contact one another. By collapsing and opening the panels, the window covering of the present invention can achieve adjustable light-control, modulatable view-through, light diffusion, excellent insulation value, all in an aesthetically pleasing design.

It is therefore a primary object of the present invention to enhance the art of window coverings and treatments.

It is another object of the present invention to provide a cellular window covering having view-through capability.

It is another object of the present invention to provide a window covering having superior insulating characteristics while at the same time providing variable view-through light control and light diffusion.

It is still another object of the present invention to provide a window covering which is readily and easily manufacturable.

It is another object of the present invention to provide for a highly aesthetically pleasing window covering.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description taken in conjunction with the accompanying drawings in which:

DESCRIPTION

It will be readily apparent that the components of the present invention, as generally described and illustrated in the Figures, could be arranged and designed in a wide variety of different configurations. Thus, the following detailed description of the presently preferred embodiments of the window covering 10 of the present invention, as represented in FIGS. 1–7, is not intended to limit the scope of the invention, as claimed, but is merely representative of the presently preferred embodiments of the invention. The presently preferred embodiments of the invention will be best understood by reference to the drawings, where like parts are designated with like numerals.

Figure 1:
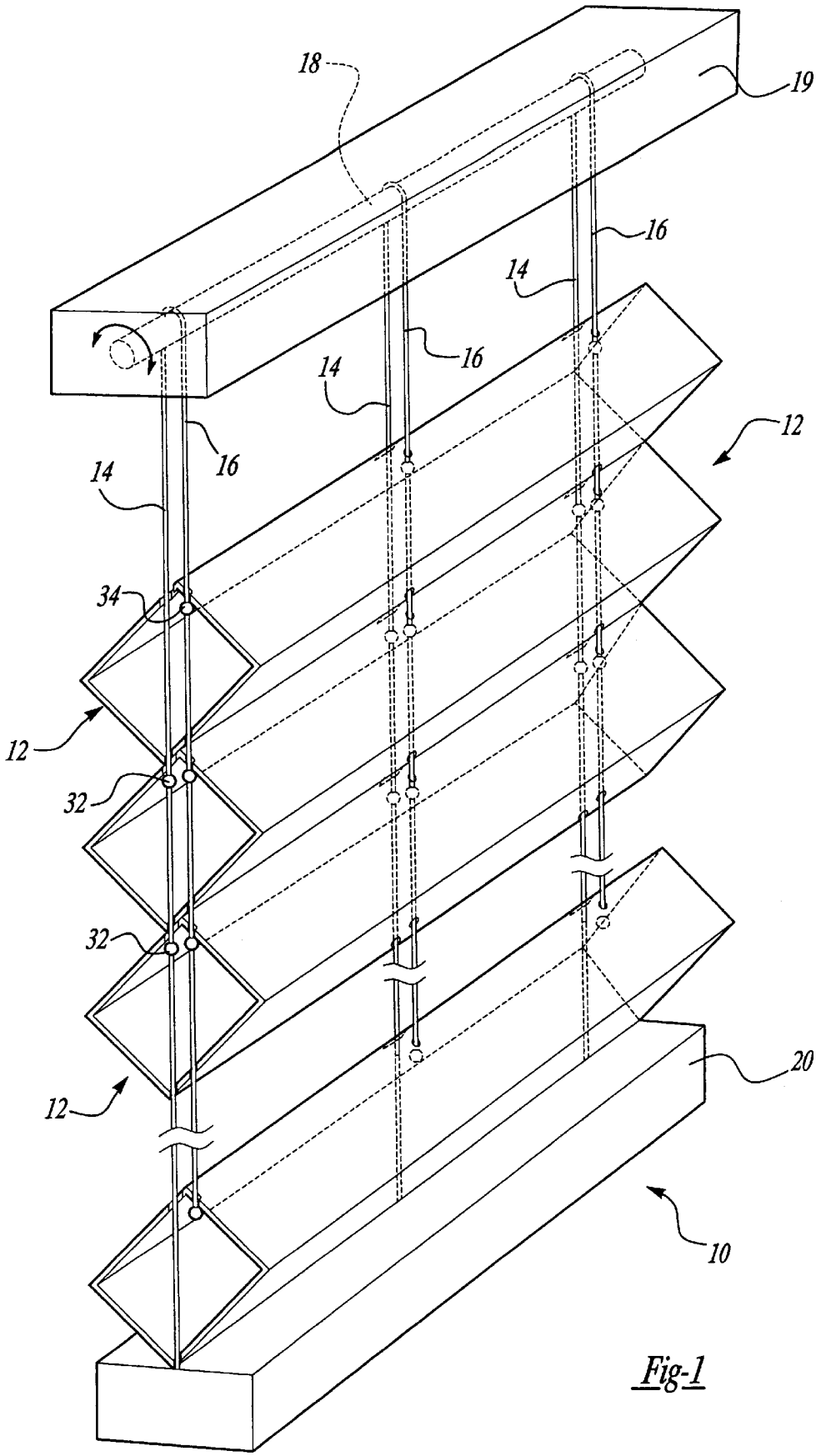
FIG. 1 is an isometric view showing a window covering constructed in accordance with the principles of the present invention, wherein a plurality of cells are arranged in the opened (expanded) position.
Figure 2:
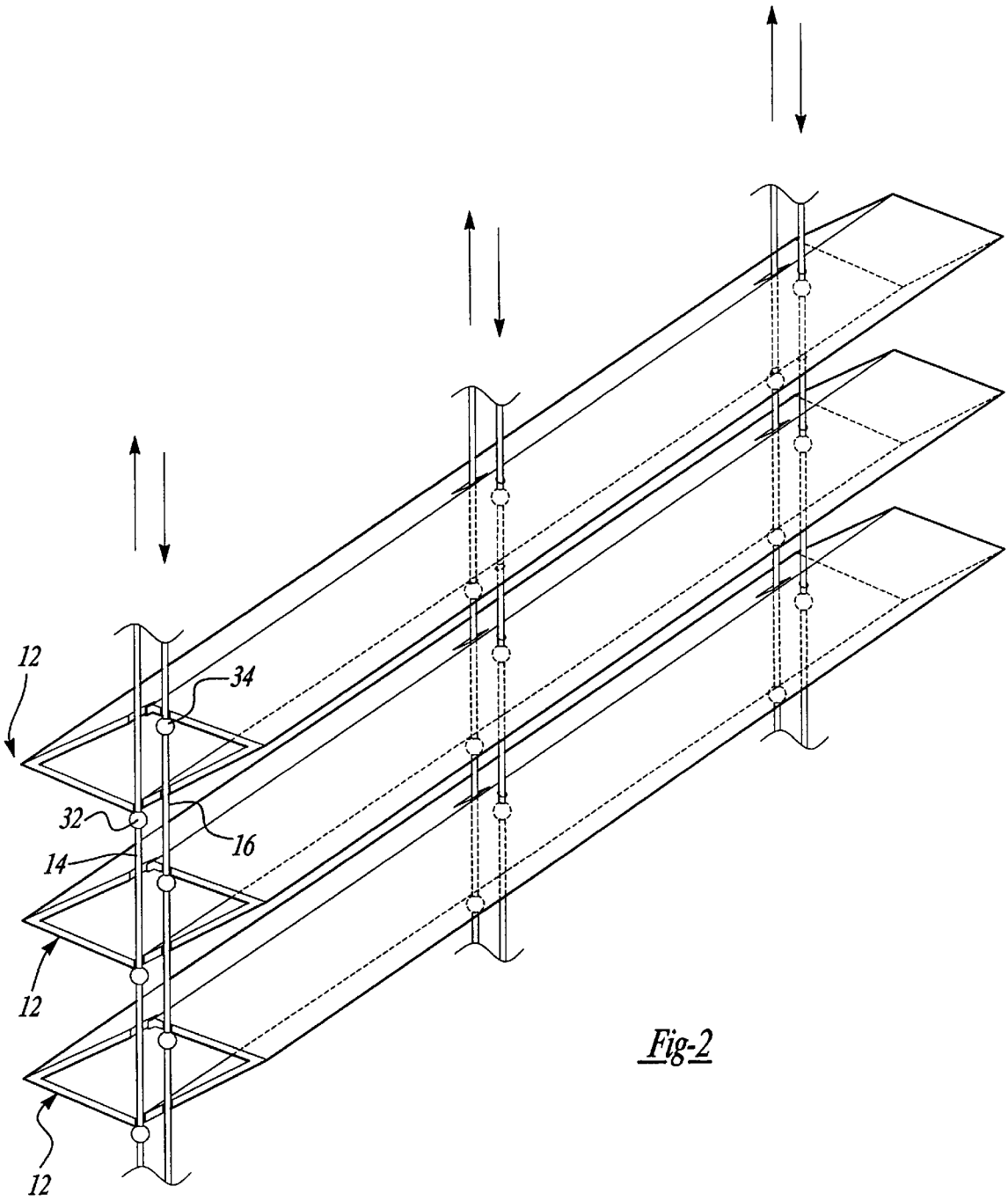
FIG. 2 an isometric view showing the window covering wherein the plurality of cells are arranged in the closed (collapsed) position.

In reference to the drawings, and more particularly to FIGS. 1 and 2, there is shown in accordance with the principles of the present invention, one embodiment of a window covering 10. Window covering 10 may include a plurality of horizontally disposed elongated cells 12, all of which are preferably arranged parallel to one another. Each cell 12 is adapted for being variably opened (expanded) and closed (collapsed) go as to provide variable light control and see-through for window covering 10. FIG. 1 depicts cells 12 in the opened position, wherein adjacent cells 12 are in contact with one another, while FIG. 2 depicts cells 12 in the closed position, wherein adjacent cells 12 are separated from one another.

In order to achieve the collapsibility and expandability of cells 12, a pair of cords, i.e., a first cord 14 and a second cord 16 may be employed in the present invention. As shown in FIGS. 1 & 2, it is contemplated that a plurality of cord pairs are disposed regularly along the length of cells 12, i.e., along the width of window covering 10, for providing support to cells 12. At an upper extreme, cords 14 and 16 may be attached to an actuator, e.g., a roller 18, for longitudinally moving cords 14 and 16. Roller 18 may be housed within an upper rail 19. As will be more specifically described hereinafter, by rotating roller 18, first cord 14 can be moved in an upward direction, thus moving second cord 16 simultaneously in a downward direction, which in turn effects the shape of cells 12 between a fully opened position and a fully closed position, and vice versa. A bottom rail 20 is disposed at a lower extreme of window covering 10.

Figure 3:
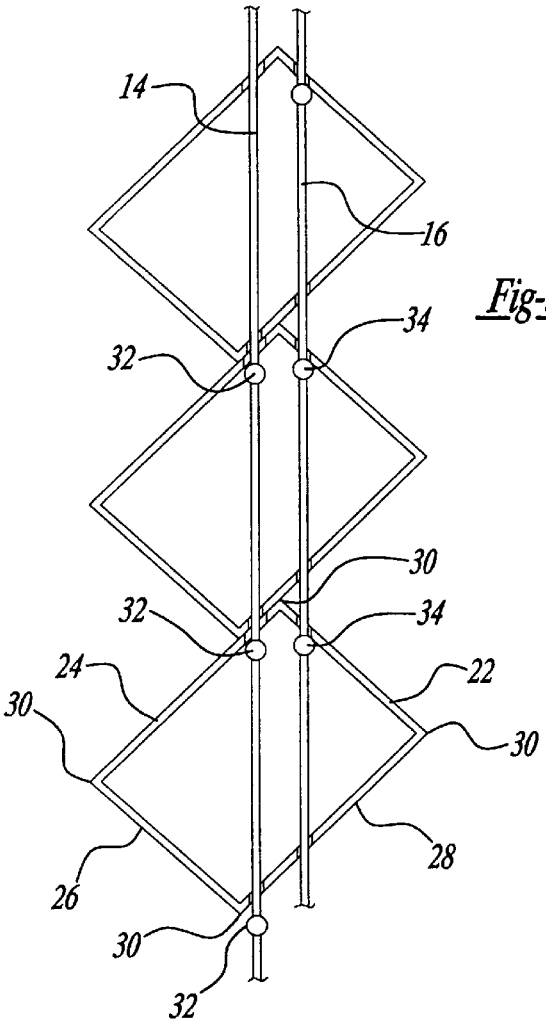
FIG. 3 is a side view depicting the cellular structure of the present invention when the cells are in the opened (expanded) position.

As illustrated best in FIG. 3, each cell 12 may have at least four sides, a first side 22, a second side 24, a third side 26 and a fourth side 28, with each side having an inner surface and an outer surface. Initially, the sides of each cell 12 may be fabricated from a soft and deformable material, such as cloth, woven or non-woven fabric, plastic or any material having the desired characteristics. As further illustrated in FIG. 3, first side 22 and second side 24 represent an upper portion of each cell 12, while third side 26 and fourth side 28 represent a lower portion of each cell 12. A pivotable hinge or juncture 30 is disposed between adjacent sides of each cell 12 so as to facilitate cell collapsibility and expandability.

Preferably, each of the Iour sides of cells 12 are rigid for providing structural stiffness and strength to each cell 12. The desired rigidity for each side of cell 12 can be achieved in any known manner, such as by forming the sides integrally stiff or by attaching or affixing a stiffener or rigid element thereto. For example, a thin sheet of hardened polyester or plastic may be adhesively bonded to each side.

However, the rigidity of each of the four sides should not interfere with the pivotability of juncture 30, but instead, should facilitate the hinge action thereof. In order to attain the pivotability of juncture 30, a natural hinge may be formed between adjacent rigid sides. More specifically, by keeping juncture 30 deformable and soft, while the surrounding sides are rigid, juncture 30 can be naturally formed therebetween.

As shown in the Figures, each cell 12, in cross-section, resembles a parallelogram, wherein opposite sides are of equal length and disposed parallel to one another. In lieu of the parallelogram configuration, however, each cell 12, in cross-section, may resemble a quadrilateral, wherein opposite sides are of unequal length and non-parallel.

In one aspect of the present invention, the beam strength or stiffness of cells 12 can be increased by cambering each side of cell 12 (see FIG. 5), as is well known to venetian blinds. A cambered configuration strengthens cell 12 over its length, thus requiring fewer cord pairs for maintaining cells 12 in the proper horizontal position, thereby preventing the sagging of cells 12.

While the preferred embodiment envisions four sides, it should be understood that the present invention is in no way so limited. Accordingly, window covering 10 need only include at least one side. In such a configuration, the cellular structure would be circular in cross-sectional configuration, i.e., a cylindrical tube, the curved outer wall representing the single side of the cell. For such a circular configuration, one juncture 30 could be provided for effecting the collapsing and expanding action of the cells.

In order to adjust the shape of each cell 12, first cord 14 is adapted to support the lower portion of each cell 12 and second cord 16 to support the upper portion of each cell 12. By raising and lowering first cord 14 and second cord 16, each cell 12 can be expanded (see FIG. 1) or collapsed (see FIG. 2).

To support the lower portion of each cell 12, first cord 14 may include a plurality of elements 32 positioned along its length. The plurality of elements 32 are preferably spaced equally apart, such as in a bead chain, and each element 32 is adapted to engage the lower portion of a corresponding cell 12. Accordingly, each element 32 may engage the outer surface of either third side 26 or fourth side 28, or both, of its corresponding cell. When first cord 14 is raised, each engaged element 32 "lifts" its associated cell 12 from the lower portion thereof. Because the lifting action of elements 32 supports respective cells 12 from their lower portions, and in effect, each cell is lifted upward, cord 14 can be referred to as a "lift" cord. As shown in FIG. 2, each element 32 is shown engaging the outer surface of fourth side 28 of each cell 12. By raising lift cord 14, each cell is caused to be raised upwardly from its lower portion, thereby resulting in the collapsing or closing of each cell 12 as illustrated in FIG. 2. In the fully expanded condition of each cell (as shown in FIGS. 1 and 3), elements 32 drop through an enlarged slot in second side 24 of the next lower cell, so as not to interfere with face-to-face contact between adjacent cells.

Figure 4:
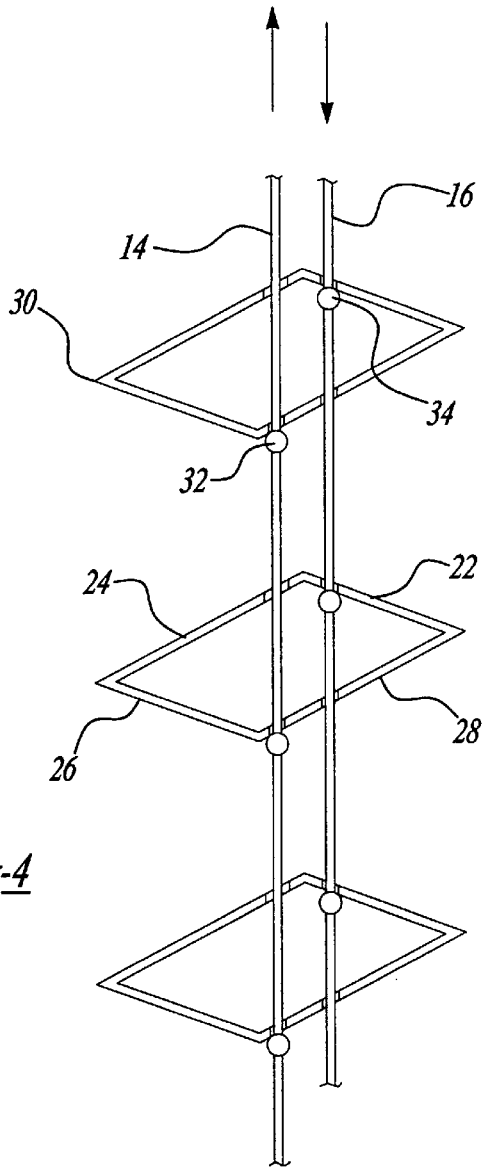
FIG. 4 is a side view depicting the cellular structure of the present invention when the cells are in the closed (collapsed) position.
Figure 5:
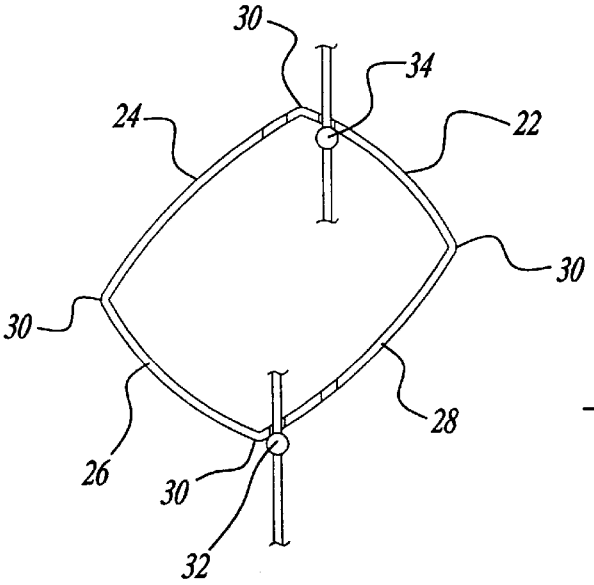
FIG. 5 is a side view depicting the cambered shape of each side of the cell of one embodiment of the present invention.

Likewise, second cord 16 may include a plurality of members 34 positioned along its length. Each member 34 serves the function of providing support to the upper portion of a corresponding cell 12. Accordingly, each member 34 may engage either the inner surface of first side 22 or second side 24, or both, of each corresponding cell 12. As shown in FIGS. 1 & 3, each member 34 is used to support each cell 12 from the upper portion thereof. Therefore, when second cord 16 is raised along its longitudinal axis, each engaged member 34 supports each cell 12 from the upper portion thereof, wherein each cell 12 tends to "hang" from its engaged member 34. As shown in FIG. 4, each member 34 is shown engaging the inner surface of first side 22 of each cell 12. By raising "hang" cord 16, each cell is caused to be suspended from its upper portion, thereby resulting in the opened or expanded position. Because members 34 act to hang cells 12 from their upper portions, second cord 16 can be referred to as a "hang" cord.

In achieving the collapsibility and expandability of cells 12, when being supported either from the upper portion or lower portion thereof by elements 32 or members 34, it is essential that the ratio of the stiffness of each cell juncture 30 to the weight of each cell 12 be selected so as to facilitate cell expandability and collapsibility. More specifically, the stiffness to weight ratio should be such that when the cells are supported from the upper portion, the weight of each cell 12 must be sufficient enough so as to facilitate the opening of the cell, and when the cells are supported from the lower portion, the stiffness of each cell must be low enough so as to facilitate the collapsing of the cell. A significant aspect of the present invention is the unique expandability or collapsibility of each cell 12 as an independent unit, wherein each cell 12 has the capability to be separated from adjacent cells.

In order to effect the longitudinal movement of first and second cords 14, 16, any known means of moving the cords up and down can be employed in the present invention. In the preferred embodiment, the upper ends of the cords may be attached to roller 18. First cord 14 may extend clockwise around roller 18, and second cord 16 may extend counterclockwise there around. When roller 18 is rotated clockwise, first cord 14 may be moved in an upward direction while second cord 16 may be simultaneously moved in a downward direction. Any conventional means can be employed in rotating roller 18, e.g., a vertically rotatable wand or control rod, a slide stick or an electric motor (none shown). While in the preferred embodiment, roller 18 is common to both first and second cords 14, 16, it should be noted that independent and separate means for moving the cords may be employed herein. Traditional venetian blind ladder cords (not shown) may also be used herein for opening and closing cells 12. Alternative to coordinated movement of both the first and second cords, means may be provided for holding one of such cords 14, 16 stationary while the other of such cords is moved, it only being necessary that relative movement between such cords be possible to change the shape of the cells. For example, the stationary cord could be anchored at both ends, one end to the bottom rail and the other to the upper rail.

Figure 6:
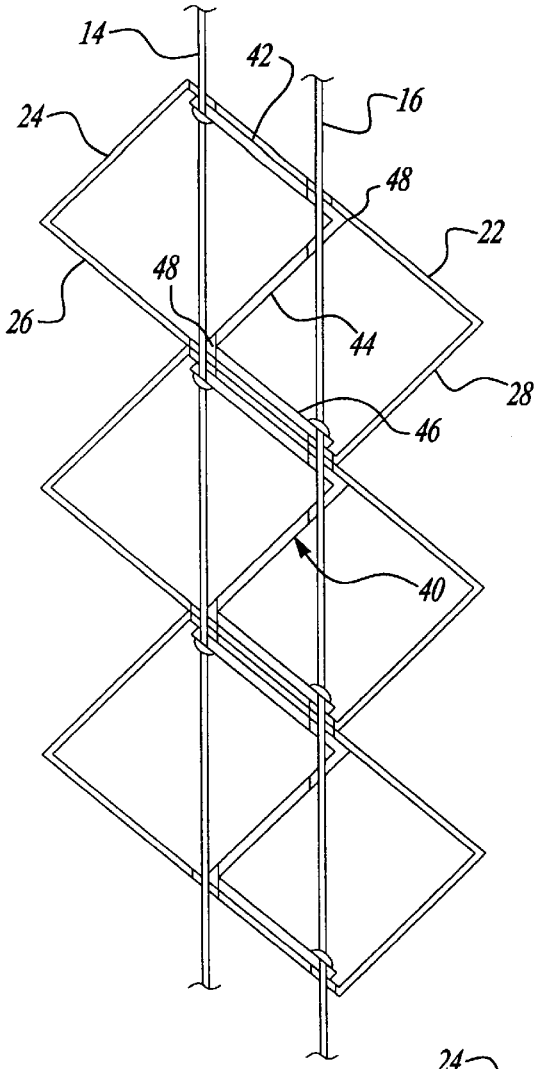
FIG. 6 is a side view depicting another embodiment of the cellular structure of the present invention, whereby each cell includes an internally disposed Z-shaped component, each of the cells being illustrated in the opened (expanded) position.
Figure 7:
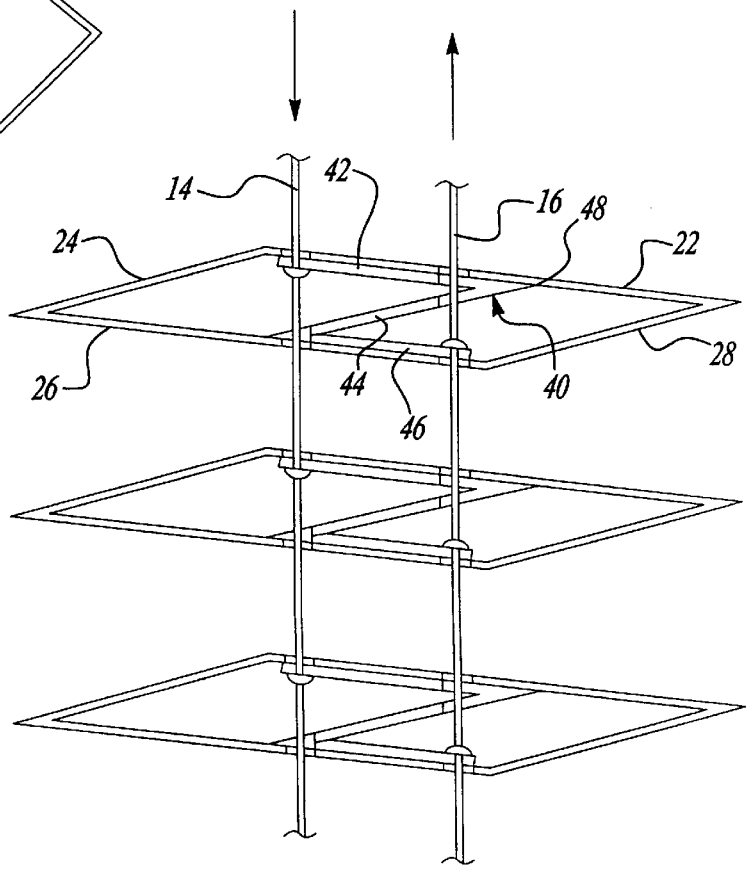
FIG. 7 is another cross-sectional view depicting the plurality disposed Z-shaped component wherein each of the cells are in the closed (collapsed) position.

Referring now to FIGS. 6 & 7, in another aspect of the present invention, a Z-shaped component 40 may be disposed within the interior of each cell 12. Component 40 may be adapted for opening and closing each cell 12. Component 40 may include an upper rigid segment 42, a central rigid segment 44, and a lower rigid segment 46. Adjacent segments have a common bendable edge 48 so that Z-shaped component 40 can be collapsed to a first position and expanded to a second position. As can be seen in FIG. 6, upper rigid segment 42 may be attached to or otherwise engaged to the inner surface of first side 22, and lower rigid segment 46 may be attached to the inner of surface, third side 26. By flattening and expanding Z-shaped component 40, the cellular structure may be variably adjusted.

First cord 14 and second cord 16 are employed in collapsing or expanding each Z-shaped component 40, and thereby each cell 12. However, instead of engaging the elements 32 and members 34 to the upper portion and lower portion of each cell, the elements and members may be engaged to or otherwise attached to the upper rigid segment 42 and lower rigid segment 46, respectively.

It may be desirable to fabricate component 40 from an opaque material, such that in the fully opened (expanded) position, the transmission of light can be entirely blocked. However, in the collapsed position, view-through capability will still exist for window covering 10. As illustrated in FIG. 1, adjacent cells 12 are in contact with one another, thereby eliminating view-through and minimizing the transfer of light through window covering 10. If cells 12 are constructed from of an opaque material, there is no view-through or light diffusion while adjacent cells 12 abut one another. If cells 12 are fabricated from a translucent material, however, uniform light diffusion can be achieved when cells 12 are in the opened or expanded position.

As shown in FIG. 2, adjacent cells 12 are disposed apart or separated from one another, thereby facilitating view-through and the transfer of light through window covering 10. In this position, cells 12 can be said to be closed or collapsed. Because of the open space between successive cells 12, there is nearly full view through capability while window covering 10 is in the position illustrated in FIG. 2. By variably adjusting the size of cells 12, a multitude of different view-through and light control positions can be achieved.

Conventional lift cords (not shown) may extend from bottom rail 20 to top rail 19 for collectively lifting and gathering cells 12, i.e., raising window covering 10.

In accordance with the subject invention, there are at least four primary modes of use. The first mode is where window covering 10 is in the fully raised position, with cells 12 being fully collapsed and gathered together near the top of window covering 10 so as to provide full view through and complete light passage through a window. In this mode of use, window covering 10 is essentially not being used. The second mode is where window covering 10 is in the deployed position (lowered), with each of the cells 12 being fully collapsed so as to provide nearly full view-through (like a traditional venetian blind when the slats or vanes are arranged substantially parallel to the plane of the ground) and significant light passage through window covering 10. In the third mode, the covering is in the deployed position, with each of cells being fully opened (expanded) so as to provide no view through, and either the diffusion of light or the full blockage of light, depending on the translucency or opacity of the cells. It is in this third mode that significant insulation advantages can be achieved. The fourth mode is where window covering 10 is in the deployed position, each cell 12 being arranged somewhere between the fully opened (expanded) and closed (closed) positions so as to provide controllable view-through and light transmission for window covering 10. This mode encompasses an entire range of cellular positions so that variable light diffusion, light control and view-through can be attained.

While several aspects of the present invention have been described and depicted herein, alternative aspects may be effected by those skilled in the art to accomplish the same objectives. For example, while the preferred embodiments of the present invention is a cellular structure having four sides, a configuration of less than four sides, or more than four sides, is envisioned within the scope of the invention. Also, while the preferred embodiment describes the cellular structure oriented horizontally, the cells may be arranged vertically. Accordingly, it is intended by the appended claims to cover all such alternative aspects as fall within the true spirit and scope of the invention.

What is claimed is:

1. A window covering comprising:

a plurality of elongated cells arranged parallel to one another, each cell having an upper portion and a lower portion;

a juncture disposed between adjacent sides of each cell, adjacent sides being pivotable about said juncture so that each cell is collapsible to a first position, wherein adjacent cells are spaced from each other to permit viewing and maximum passage of light therebetween, and openable to a second position, wherein adjacent cells are substantially contiguous to substantially block viewing therebetween;

the weight of said cells and the stiffness of said cell sides being selected so that, when each cell is freely suspended solely from its respective upper portion, it will hang in its fully opened second position, and as more of the weight of each cell is supported from its respective lower portion, it will move toward its collapsed first position;

a first cell-shaping control element engaged with said upper portion of each of said cells, and a second cell-shaping control element engaged with said lower portion of each of said cells;

actuation means connected to said first and second control elements to selectively move said first and said second control elements in opposite vertical directions, upward movement of said first control element moving said upper portion of each of said cells toward their fully opened condition, and upward movement of said second control element lifting said lower portion of each of said cells to move said cells toward their collapsed condition.

2. The window covering of claim 1 wherein said first cell-shaping control element comprises a cord-like member having a plurality of enlarged portions spaced along its length, one of said enlarged portions being located inside each of said cells for engagement with said upper portion of said cell to selectively lift said upper portion to move said cell toward its opened condition.

3. The window covering of claim 1 wherein said second cell-shaping control element comprises a cord-like member having a plurality of enlarged portions spaced along its length, one of said enlarged portions being positioned immediately below said lower portion of each of said cells to engage the outer surface thereof to selectively lift said lower portion to move said cell toward its collapsed condition.

4. A window covering comprising:

a plurality of elongated cells arranged parallel to one another, each cell having four sides;

a juncture disposed between adjacent sides of each cell, adjacent sides being pivotable about said juncture so that each cell is collapsible to a first position, wherein adjacent cells are spaced from each other, and openable to a second position, wherein adjacent cells are substantially contiguous to substantially block viewing therebetween;

a Z-shaped cell-shaping member disposed within each of said cells and adapted for opening and closing said cells, said Z-shaped member comprising first and second substantially rigid segments and a central substantially rigid segment joined at its respective ends to said first and second segments by pivotable hinge joints, said first segment being secured to a first of said cell sides and said second segment being secured to a second of said cell sides which is not adjacent to said first cell side;

a first control member engaged with said first segment of each of said Z-shaped members, and a second control member engaged with said second segment of each of said Z-shaped members;

actuation means connected to said first control member to move said first Z-shaped member segments in a cell-opening direction, and further connected to said second control member to move said second Z-shaped member segments in a cell-collapsing direction.

5. The window covering of claim 4 wherein said actuation means causes said first and second control members to simultaneously move in parallel but opposite longitudinal directions.

6. A window covering comprising:

a plurality of elongated cells arranged parallel to one another, each cell having an upper portion and a lower portion;

a juncture disposed between adjacent sides of each cell, adjacent sides being pivotable about said juncture so that each cell is collapsible to a first position, wherein adjacent cells are spaced from each other to permit viewing and maximum passage of light therebetween, and openable to a second position, wherein adjacent cells are substantially contiguous to substantially block viewing therebetween;

the weight of said cells and the stiffness of said cell sides being selected so that, when each cell is freely suspended solely from its respective upper portion, it will hang in its fully opened second position, and as more of the weight of each cell is supported from its respective lower portion, it will move toward its collapsed first position;

a first cell-shaping control element engaged with said upper portion of each of said cells, and a second cell-shaping control element engaged with said lower portion of each of said cells;

actuation means connected to at least one of said first and second control elements to selectively create movement in the vertical direction between said first and said second control elements, whereby such relative movement changes the shape of the cells to thereby modify the size of the space between adjacent cells.

* * * * *